US009912098B2

(12) United States Patent
Shibata

(10) Patent No.: US 9,912,098 B2
(45) Date of Patent: Mar. 6, 2018

(54) CONNECTOR WITH WIRE COVER

(71) Applicant: Sumitomo Wiring Systems, Ltd., Yokkaichi, Mie (JP)

(72) Inventor: Takahiro Shibata, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/027,044

(22) PCT Filed: Oct. 14, 2014

(86) PCT No.: PCT/JP2014/077305
§ 371 (c)(1),
(2) Date: Apr. 4, 2016

(87) PCT Pub. No.: WO2015/064352
PCT Pub. Date: May 7, 2015

(65) Prior Publication Data
US 2016/0240962 A1 Aug. 18, 2016

(30) Foreign Application Priority Data
Oct. 29, 2013 (JP) ..... 2013-224433

(51) Int. Cl.
*H01R 13/621* (2006.01)
*H01R 13/58* (2006.01)
*H01R 13/447* (2006.01)

(52) U.S. Cl.
CPC ..... *H01R 13/5812* (2013.01); *H01R 13/447* (2013.01); *H01R 13/6215* (2013.01)

(58) Field of Classification Search
CPC ..... H01R 13/5812; H01R 13/447; H01R 13/6215; H01R 13/512
(Continued)

(56) References Cited

U.S. PATENT DOCUMENTS 5,007,858 A * 4/1991 Daly ..... H01R 23/661 439/291
5,700,156 A * 12/1997 Bussard ..... H01R 13/5804 439/471
(Continued)

FOREIGN PATENT DOCUMENTS

JP 5-290924 11/1993
JP 8-195254 7/1996
(Continued)

OTHER PUBLICATIONS

International Search Report.

*Primary Examiner* — Renee Luebke
*Assistant Examiner* — Paul Baillargeon
(74) *Attorney, Agent, or Firm* — Gerald E. Hespos; Michael J. Porco; Matthew T. Hespos

(57) ABSTRACT

A connector (10) includes a housing (20) having a wire pull-out surface (27), and wires (500) are pulled out from the wire pull-out surface (27). The housing (20) also has an outer peripheral surface (28) arranged to intersect with the wire pull-out surface (27). A wire cover (60), including a cover main body (61), is mounted on the housing (20) and is arranged to cover the wire pull-out surface (27) of the housing (20) while having the wires (500) arranged inside. A fitting tube (63) is connected integrally to the cover main body (61). The fitting tube (63) covers the outer peripheral surface (28) of the housing (20) and is held in a state where rotation about an axis extending in a fitting direction of the fitting tube (63) is regulated.

4 Claims, 7 Drawing Sheets

(58) Field of Classification Search
USPC ..... 439/464, 471, 473, 470
See application file for complete search history.

(56) References Cited

U.S. PATENT DOCUMENTS 5,897,392 A * 4/1999 Takahashi ..... B60R 16/0215
429/121
6,824,420 B2 * 11/2004 Ushiro ..... H01R 13/5816
439/455

FOREIGN PATENT DOCUMENTS

JP 2012-234659 11/2012
JP 2013-122900 6/2013

* cited by examiner

CONNECTOR WITH WIRE COVER

BACKGROUND

1. Field of the Invention

The present invention relates to a connector.

2. Description of the Related Art

A connector described in Japanese Unexamined Patent Publication No. 2013-122900 includes a housing having a wire pull-out surface from which wires are pulled out, and a wire cover to be mounted on the housing to cover the wire pull-out surface of the housing. The wire cover is cap-like and a cover lock is provided on an opening edge thereof. Further, a housing lock is provided on the outer peripheral edge of the wire pull-out surface of the housing. When the wire cover is mounted on the housing, the cover lock is locked resiliently to the housing lock with an outer peripheral opening edge of the wire cover held in contact with the outer peripheral edge of the wire pull-out surface of the housing so that the wire cover is retained and held on the housing.

In the above case, if the wires pulled out to the outside of the wire cover vibrate a large amount with the wire cover mounted on the housing, a vibration force of the wires is transferred to the wire cover and the wire cover is twisted about an axis relative to the housing in some cases. As a result, a locked state of the cover lock and the housing lock may be released and the wire cover may be detached from the housing.

The present invention was completed based on the above situation and aims to prevent a wire cover from being detached from a housing.

SUMMARY

The invention is directed to a connector with a housing having a wire pull-out surface from which a wire is pulled out. The housing further has an outer peripheral surface arranged to intersect with the wire pull-out surface. A wire cover is mounted on the housing and has a cover main body arranged to cover the wire pull-out surface of the housing while having the wire arranged inside. A fitting tube is connected integrally to the cover main body. The fitting tube is fit to cover the outer peripheral surface of the housing and is held in a state where rotation about an axis extending in a fitting direction of the fitting tube is regulated.

According to the above configuration, even if the wire pulled out to the outside of the wire cover vibrates and a vibration force of the wire is transferred to the wire cover, the wire cover is prevented from being detached from the housing since the fitting tube of the wire cover is fit to cover the outer peripheral surface of the housing and is held in the state where the rotation about the axis extending in the fitting direction of the fitting tube is regulated. Further, a situation where the outer peripheral surface of the housing is broken is prevented since the outer peripheral surface of the housing is covered by the fitting tube.

The fitting tube includes a cover lock located on a side opposite to the wire pull-out surface in the housing. The cover lock is to be hooked and locked to an outer peripheral side of a connection surface facing a mating housing when the housing is connected to the mating housing. According to this configuration, the shape of a side of the housing for receiving the cover lock need not be complicated.

The cover main body has a front view shape with four corners that protrude out and the cover locks are arranged at positions facing the four corners of the cover main body.

This realizes a structure in which the wire cover is less likely to be detached from the housing.

At least one housing lock that is lockable to the cover lock is provided on the outer peripheral side of the connection surface of the housing and the housing lock is arranged to be continuous and flush with the other part of the outer peripheral side of the connection surface of the housing. Thus, the housing lock need not have a special shape and the conventional housing can be used as it is.

The housing is connected to the mating housing by bolt fastening. In the case of connecting the two housings by bolt fastening in this way, the connector tends to be enlarged, the wire tends to have a larger diameter and a vibration force of the wire tends to be transferred to the wire cover. Thus, an advantage of preventing the detachment of the wire cover from the housing by applying the above configuration is large.

The fitting tube is fit to entirely cover the outer peripheral surface of the housing except in a region corresponding to a part from which the wire is drawn out. According to this configuration, a situation where the outer peripheral surface of the housing is broken when the connector drops down is prevented more reliably since the outer peripheral surface of the housing is protected by the fitting tube.

The wire cover includes a guide integrally connected to the cover main body and projecting in a direction intersecting with the fitting tube, and the wire pulled out from the wire pull-out surface is fixed to the guide. If the wire is fixed to the guide in this way, a vibration force of the wire is directly transferred to the wire cover. Thus, the advantage of preventing the detachment of the wire cover from the housing by applying the present invention is large.

DETAILED DESCRIPTION

Figure 1:
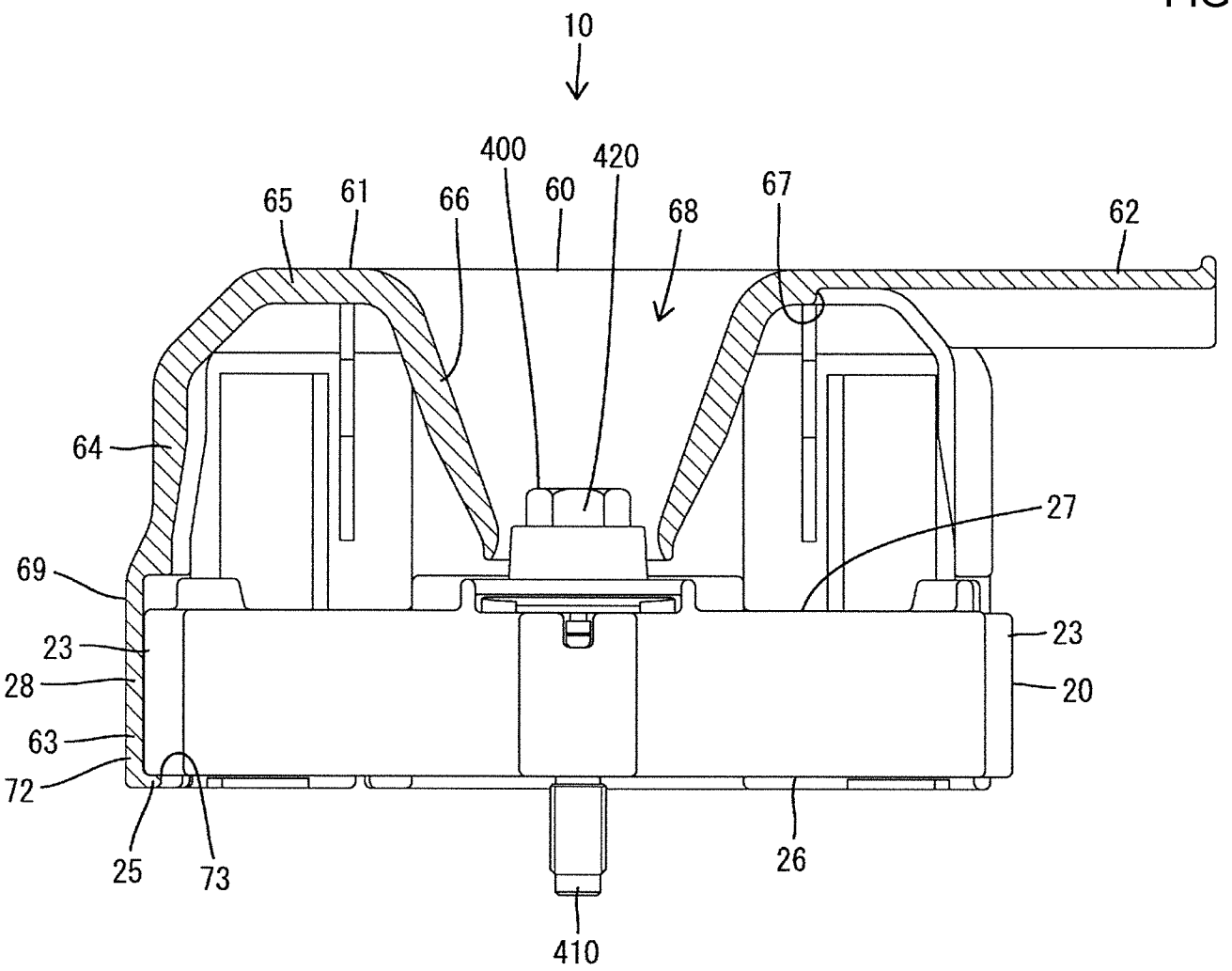
FIG. 1 is a side view with an essential part shown in section showing a state where a wire cover is mounted on a housing.

Hereinafter, an embodiment of the present invention is described with reference to FIGS. 1 to 7. A connector 10 of this embodiment includes a housing 20, a wire cover 60 to be mounted on the housing 20 and terminal fittings 90 to be accommodated into the housing 20. As shown in FIG. 2, the housing 20 is connectable to a mating housing 100. Note that, in the following description, a surface of the housing 20 facing the mating housing 100 when the connection of the housing 20 to the mating housing 100 is started (side of a connection surface 26 to be described later and lower side in FIGS. 1, 2, 6 and 7) is referred to as a front concerning a front-back direction and a left side and a right side of each figure are referred to as an upper side and a lower side concerning a vertical direction.

The mating housing 100 is made of synthetic resin and, as shown in FIG. 2, shaped to be long and narrow in the vertical direction as a whole. Unillustrated mating terminal fittings are accommodated in the mating housing 100 and a nut 200 is mounted in a central part of the mating housing 100. The nut 200 is positioned in the front-back direction with respect to the mating housing 100 and held so that rotation about an axis extending in the front-back direction is regulated.

Figure 7:
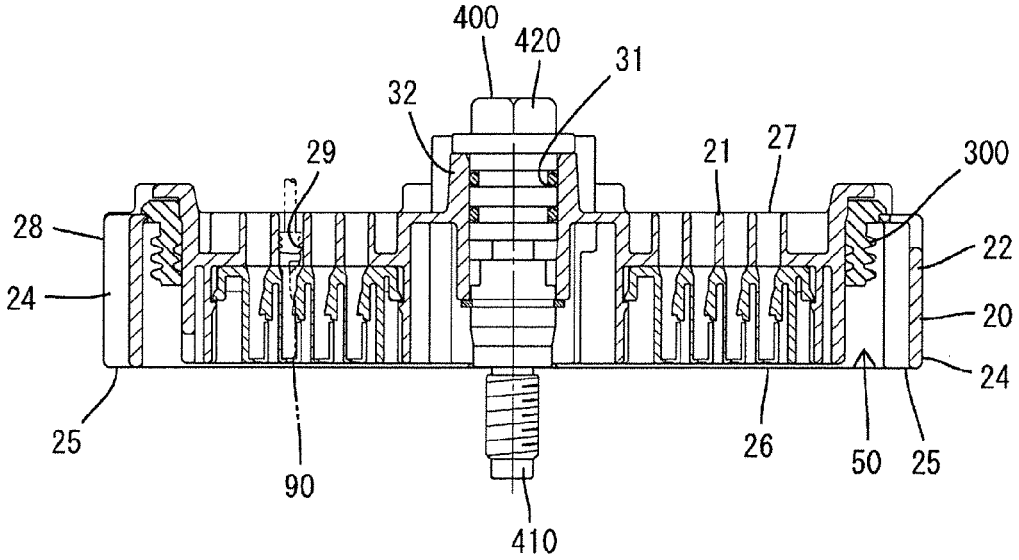
FIG. 7 is a section of the housing mounted with a bolt.

The housing 20 is made of synthetic resin and, as shown in FIG. 7, is shaped to be long and narrow in the vertical direction as a whole and includes a block-like housing main body 21 and a tubular receptacle 22 surrounding the housing main body 21.

Figure 4:
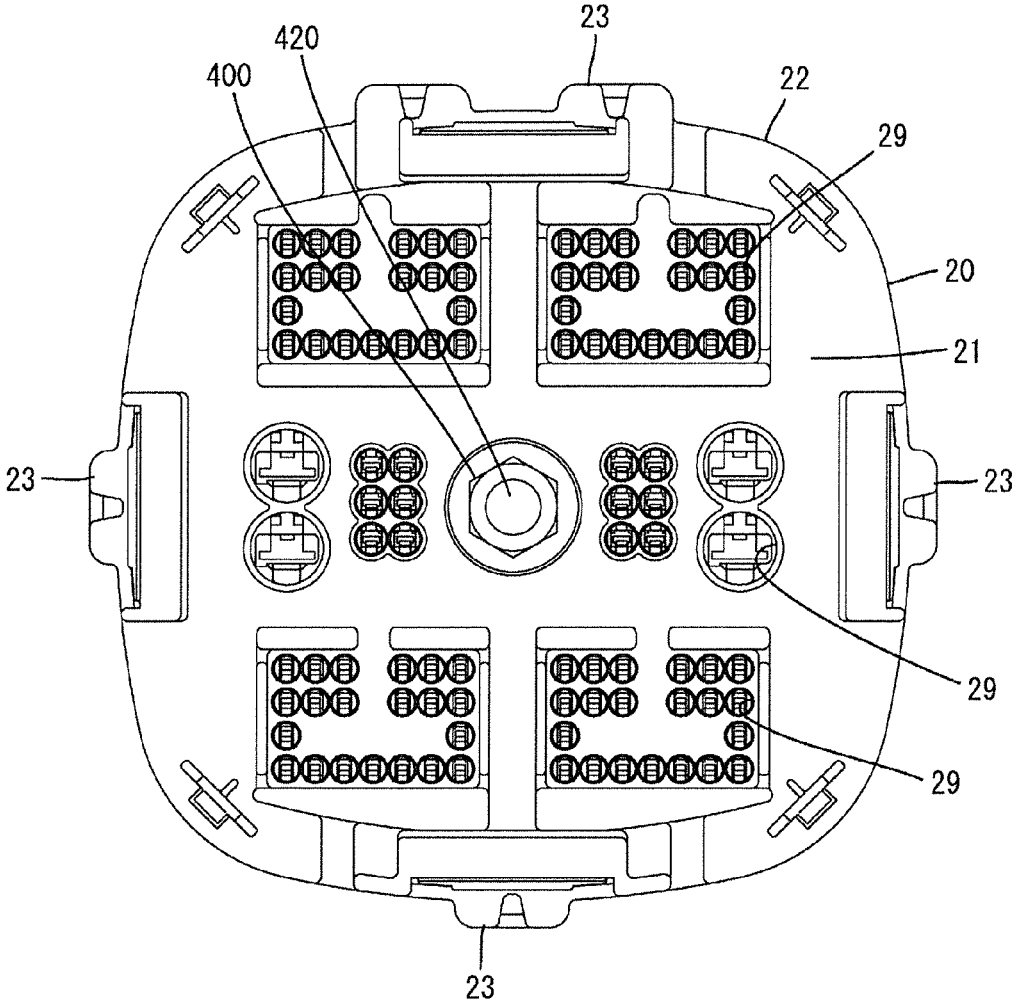
FIG. 4 is a rear view of the housing.

As shown in FIG. 7, a space between the housing main body 21 and the receptacle 22 is open forward as a connection space 50 into which the mating housing 100 is inserted from the front. A seal ring 300 is fit on the outer peripheral surface of the housing main body 21 and, when the two housings 20, 100 are connected, resiliently sandwiched between the housing main body 21 and the receptacle 22, thereby sealing between the two housings 20, 100 in a liquid-tight manner. As shown in FIG. 4, protrusions 23 forming a locking structure for retaining the seal ring 300 are provided on both upper and lower surfaces and both front and rear surfaces of the receptacle 22. Further, housing locks 25 lockable to cover locks 72 to be described later are provided at positions corresponding to four corners on the front end of the receptacle 22 (on an outer peripheral side of the later-described connection surface 26 of the housing 20). The housing locks 25 are arranged to be continuous and flush with other parts of the front end of the receptacle 22 and do not necessarily have a specific shape.

Figure 2:
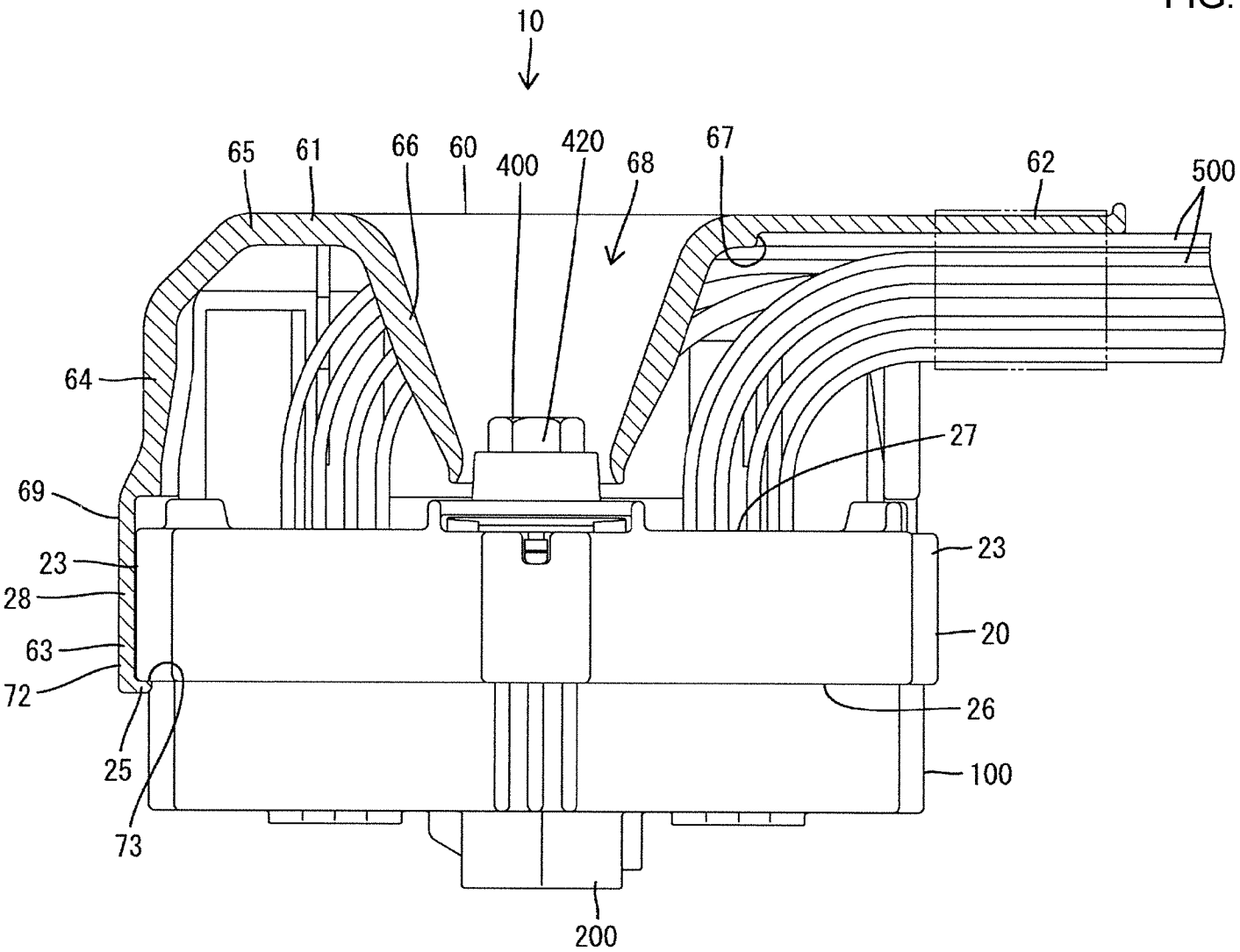
FIG. 2 is a side view with an essential part shown in section showing a state where the housing is connected to a mating housing.

As shown in FIGS. 1 and 7, the front surface of the housing 20 constitutes the connection surface 26 facing the mating housing 100 at the time of connection, and the rear surface of the housing 20 located on a side opposite to the connection surface 26 constitutes a wire pull-out surface 27 from which wires 500 are pulled out. The housing 20 has an outer peripheral surface 28 facing in a backward direction intersecting with plane directions of the connection surface 26 and the wire pull-out surface 27 between the connection surface 26 and the wire pull-out surface 27. As shown in FIG. 7, cavities 29 into which the terminal fittings 90 are insertable are provided in the housing 20. Each cavity 29 extends in the front-back direction and the opposite front and rear ends thereof are respectively open on the connection surface 26 and the wire pull-out surface 27. When the terminal fitting 90 is inserted into each cavity 29 of the housing 20, the wire 500 connected to each terminal fitting 90 is pulled out from the wire pull-out surface 27.

Further, as shown in FIG. 7, the housing 20 is provided with a through hole 31 extending in the front-back direction and is open in central parts of the respective wire pull-out surface 27 and connection surface 26. A tubular pedestal 32 surrounding the through hole 31 is provided to project back in the central part of the wire pull-out surface 27 of the housing 20. A shaft 410 of a bolt 400 is fit and mounted in the through hole 31. The bolt 400 is such that a head 420 having a hexagonal shape in a rear view is formed to protrude radially from the rear end of the shaft 410 long and narrow in the front-back direction. When the bolt 400 is mounted into the through hole 31 of the housing 20, the head 420 is arranged to project farther back than the wire pull-out surface 27 of the housing 20 while being supported on the rear end of the pedestal 32, and the shaft 410 is arranged to project farther forward than the connection surface 26 of the housing 20.

The outer peripheral surface of the shaft 410 is threaded to be threadably engaged with the nut 200. In connecting the two housings 20, 100, the shaft 410 of the bolt 400 is inserted into the nut 200 with the two housings 20, 100 lightly fit together. Subsequently, an unillustrated tool is fit to the head 420 of the bolt 400 and turned. Then, the shaft 410 of the bolt 400 is tightened into the nut 200. In this way, the two housings 20, 100 approach each other, thereby being brought to a properly connected state shown in FIG. 2.

Figure 3:
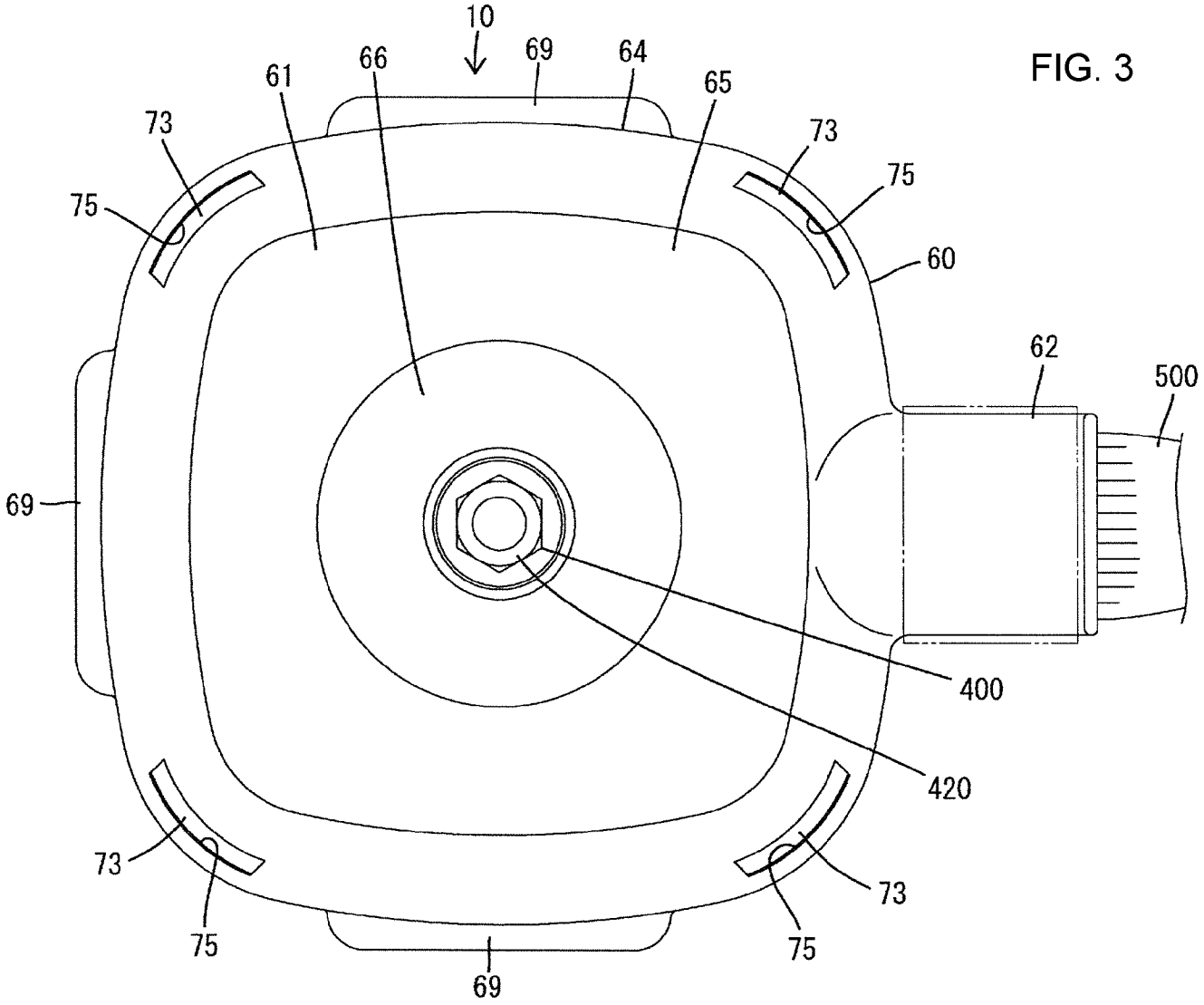
FIG. 3 is a rear view of a connector.
Figure 5:
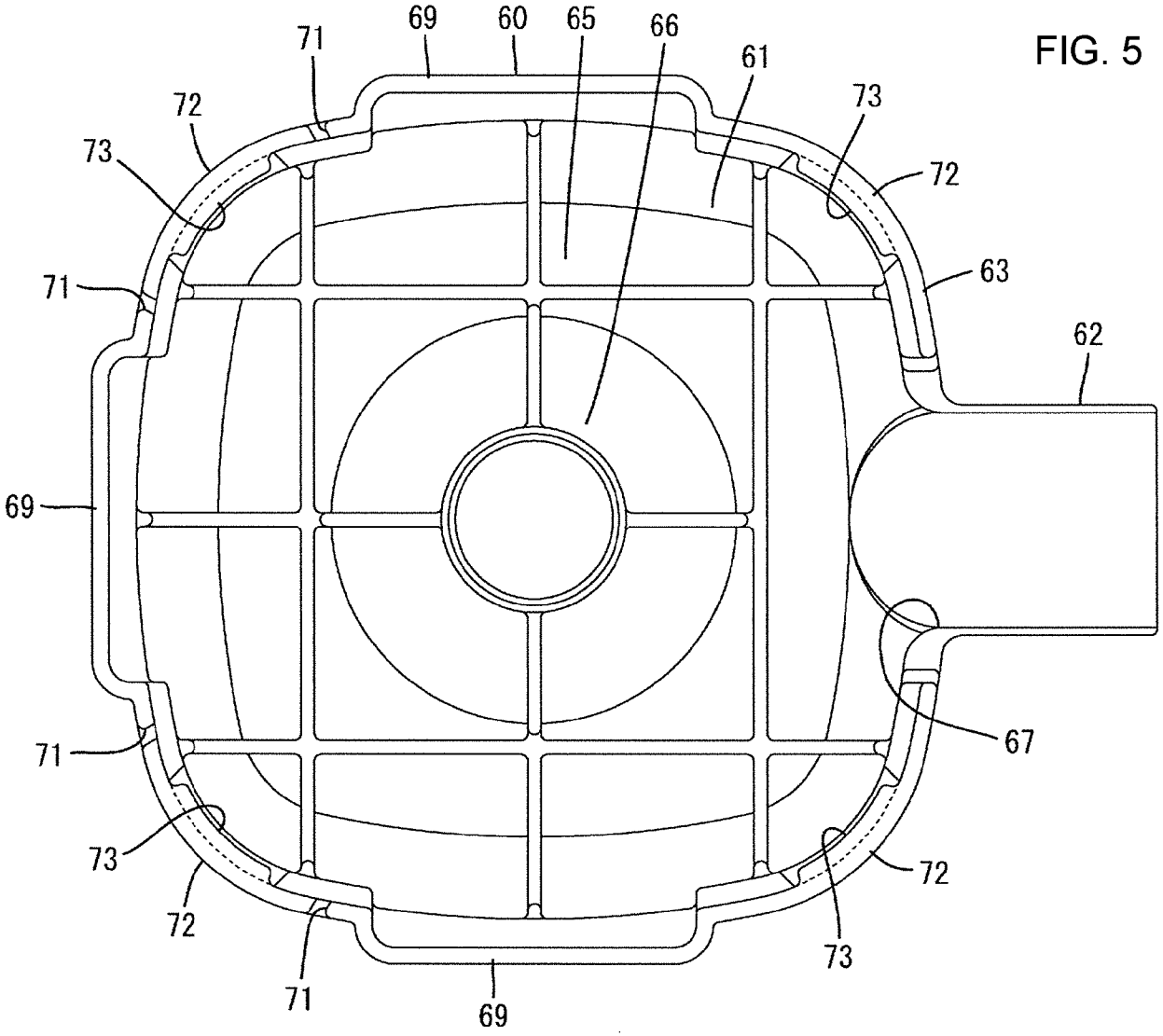
FIG. 5 is a front view of the wire cover.
Figure 6:
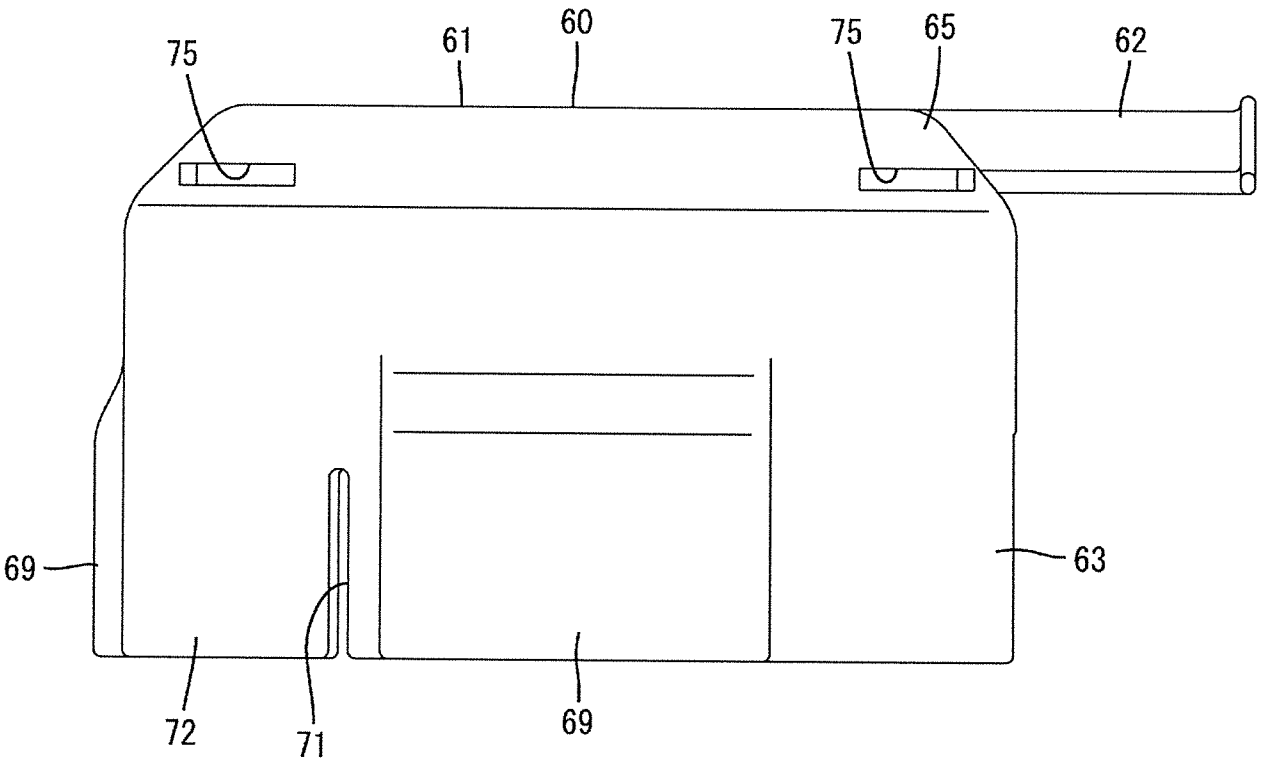
FIG. 6 is a side view of the wire cover.

The wire cover 60 also is made of synthetic resin to be cap-like as a whole and is mounted on the housing 20 from behind. Specifically, the wire cover 60 includes, as shown in FIGS. 3 and 5, a cover main body 61 having a substantially rectangular outer peripheral edge whose four corners protrude out when viewed from behind or front. A guide 62 is connected integrally to the cover main body 61 and projects down, and a tubular fitting tube 63 is connected integrally to the cover main body 61 and projects forward as shown in FIGS. 5 and 6.

As shown in FIGS. 1 to 3, the cover main body 61 is composed of an outer peripheral wall 64 extending back (in a direction away from the wire pull-out surface 27) from the outer peripheral edge of the wire pull-out surface 27 of the housing 20 with wire cover 60 mounted on the housing 20, a substantially annular rear wall 65 connected to the outer peripheral wall 64 and a cylindrical tubular portion 66 extending forward (in a direction toward the wire pull-out surface 27) from the inner peripheral edge of the rear wall 65. A lower side of the outer peripheral wall 64 is cut partially in a circumferential direction, thereby forming a draw-out opening 67. The guide 62 is in the form of a projecting piece having an arcuate cross-section and extending down from a rear opening edge part of the draw-out opening 67. As shown in FIG. 2, the respective wires 500 pulled out from the wire pull-out surface 27 of the housing 20 are drawn out to the outside of the wire cover 60 along the guide 62 from the draw-out opening 67 after being turned in the wire cover 60. At this time, the respective wires 500 are taped and fixed to the guide 62.

The tubular portion 66 is formed by recessing a central part of the outer surface of the cover main body 61, and that recessed space serves as a work space 68 into which a tool for bolt tightening is insertable. When the wire cover 60 is mounted on the housing 220, a front end opening edge of the tubular portion 66 is arranged to surround the pedestal 32 of the housing 20.

The fitting tube 63 projects forward from a part of the front end of the outer peripheral wall 64 except at a position corresponding to the draw-out opening 67 and includes bulges 69 protruding out on the upper and both front and rear surfaces thereof, as shown in FIGS. 3 and 5. As shown in FIGS. 1 and 2, the inner surfaces of the bulges 69 are arranged to be connected to the front end of the outer peripheral wall 64 via steps. The fitting tube 63 is fit to substantially entirely cover a part of the outer peripheral surface 28 of the receptacle 22 except in a region corresponding to the draw-out opening 67. In this case, the bulging portions 69 are arranged while surrounding the protrusions 23 of the receptacle 22.

As shown in FIGS. 5 and 6, the fitting tube 63 is provided with slits 71 extending in the front-back direction and open on the front end at opposite circumferential sides of upper two corners distant from the guide portion 62 out of four corners. Further, deflectable cover lock portions 72 are provided between the slits 71 facing each other in the circumferential direction and on parts facing parts between those slits 71 at the respective four corners of the fitting tube 63. The cover locks 72 have such cross-sectional shapes arcuately curved along the four corners of the fitting tube 63. Further, the front ends of the cover locks 72 are arranged at the same position as other parts of the front end of the fitting tube 63 in the front-back direction. As shown in FIG. 5, a claw-like lock projection 73 to projects in on a front end part of the cover lock 72. With the wire cover 60 mounted on the housing 20, the lock projections 73 of the cover locks 72 are held resiliently in contact with the housing locks 25 on the front end of the receptacle 22 so that the wire cover 60 is fit and held on the housing 20. Note that, as shown in FIG. 3, arcuate mold removal holes 75 are open on four corners of the rear wall 65 of the cover main body 61 due to the passage of an unillustrated mold for forming the lock projections 73.

Next, how to assemble the connector 10 of this embodiment is described.

In assembling, the terminal fittings 90 are inserted into the respective cavities 29 of the housing 20. When the terminal fittings 90 are inserted properly into the cavities 29, the respective wires 500 are pulled out from the wire pull-out surface 27 and arranged. Subsequently, the wire cover 60 is mounted on the housing 20. In the mounting process, the lock protrusions 73 of the respective cover locks 72 slide on the outer peripheral surface 28 of the housing 20 and the respective cover locks 72 are deflected out. When the wire cover 60 reaches a proper mounted position, as shown in FIG. 1, the respective cover locks 72 resiliently return and the lock protrusions 73 are arranged to be lockable to the corresponding housing locks 25. At this time, the lock protrusions 73 of the respective cover lock portions 72 move around four corner parts of the outer peripheral side of the connection surface 26 of the housing 20 so that the housing 20 is embraced by the wire cover 60.

Both the outer peripheral surface 28 of the housing 20 and the fitting tube 63 have a substantially rectangular cross-sectional shape with rounded four corner parts, i.e. a non-circular cross-sectional shape. Thus, the rotation of the fitting tube 63 about an axis extending in the front-back direction (fitting direction of the fitting tube 63 onto the housing 20) relative to the housing 20 is regulated with the fitting tube 63 externally fit on the housing 20. Thus, even if an impact such as an external force is applied to the wire cover 60, the wire cover 60 is not displaced about the axis relative to the housing 20 and a state where each cover lock 72 is locked to the corresponding housing lock portion 25 is held.

If the respective wires 500 are inclined a large amount and swung in a direction intersecting with an original draw-out direction, such as when the connector 10 is suspended by holding the respective wires 500 pulled out from the guide portion 62 of the wire cover 60, an excessive torsional force acts on the wire cover 60 via the guide 62 to displace a relative position of the wire cover 60 with respect to the housing 20 about the axis. However, according to this embodiment, the fitting tube 63 is fit to cover the outer peripheral surface 28 of the housing 20 and held in the state where the rotation thereof about the axis extending in the front-back direction is regulated. Thus, the wire cover 60 is held firmly on the housing 20 against the torsional force. Therefore, the torsional force does not directly act on the cover locks 72 and the locked state of the cover locks 72 and the housing locks 25 is maintained stably. As a result, the wire cover 60 is not detached inadvertently from the housing 20.

Further, according to the embodiment, the outer peripheral surface 28 of the housing 20 is covered substantially entirely by the fitting tube 63 except in the region corresponding to the draw-out opening 67 of the wire cover 60. Thus, a situation where the outer peripheral surface 28 of the housing 20 is broken, such as when the connector 10 drops down, is prevented.

Furthermore, the lock protrusions 73 of the respective cover locks 72 are hooked resiliently and locked to the four corners of the outer periphery of the connection surface 26 of the housing 20 so that the wire cover 60 is retained stably and held on the housing 20. In addition, the housing locks 25 for receiving the respective cover locks 72 are formed only as the front edge of the receptacle 22 on the outer peripheral side of the connection surface 26 of the housing 20 and do not have a specific shape. Thus, the configuration of the housing 20 can be simplified and the conventional housing 20 can be used as it is.

The invention is not limited to the above described and illustrated embodiment. For example, the following modes also are included in the technical scope of the invention.

The respective formation positions of the cover locks and the housing locks are not limited if the cover locks and the housing locks are arranged at such positions as to be engaged with each other. For example, the housing locks may project back from the wire pull-out surface of the housing and the cover locks may project forward from the cover main body of the wire cover.

The fitting tube may not be formed with the slits and all the cover locks may be deformed resiliently without the slits. Conversely, all the cover locks may be deformed resiliently via the slits.

The housing may be connected and held to the mating housing by resilient locking by a lock arm and a lock projection as in ordinary connectors rather than being connected and held to the mating housing by bolt tightening.

LIST OF REFERENCE SIGNS

10 . . . connector
20 . . . housing
25 . . . housing lock
26 . . . connection surface
27 . . . wire pull-out surface
28 . . . outer peripheral surface
60 . . . wire cover
61 . . . cover main body
63 . . . fitting tube
72 . . . cover lock
100 . . . mating housing
400 . . . bolt
500 . . . wire

The invention claimed is:

1. A connector, comprising:

a housing having opposite front and back ends and a wire pull-out surface defining the back end, a wire being pulled out from the wire pull-out surface, and an outer peripheral surface arranged to intersect with the wire pull-out surface and extending between the front and back ends; and a wire cover including a cover main body mounted on the housing in a backward to forward direction and arranged to cover the wire pull-out surface of the housing while having the wire arranged inside, and a fitting tube integrally connected to a forward end of the cover main body and fitted to cover the outer peripheral surface of the housing, a leading end of the fitting tube having a plurality of pairs of slits extending backward from the leading end of the fitting tube and arranged circumferentially around the leading end, and a plurality of deflectable cover lock portions, individual ones of the plurality of deflectable cover lock portions being arranged respectively between each of the pair of slits, wherein the plurality of deflectable cover lock portions are outwardly deflected when the cover main body is mounted to the housing, and resiliently return to engage the front end of the housing in a state where rotation about an axis extending in a fitting direction of the fitting tube is regulated.

2. The connector of claim 1, wherein housing locks lockable to the plurality of cover lock portions are provided on an outer peripheral side of a connection surface of the housing and the housing lock is arranged to be continuous and flush with other parts of the outer peripheral side of the connection surface of the housing.

3. The connector of claim 1, wherein the housing is connected to a mating housing by bolt fastening.

4. The connector of claim 1, wherein the fitting tube is fit to entirely cover the outer peripheral surface of the housing except in a region corresponding to a part from which the wire is drawn out.

* * * * *